United States Patent [19]

Therkelsen

[11] 3,945,057

[45] Mar. 23, 1976

[54] CONTROL FOR WATER CLOSETS

[76] Inventor: Louis J. Therkelsen, 28875 Georgia Road, Perrysburg, Ohio 43551

[22] Filed: Mar. 27, 1975

[21] Appl. No.: 563,176

[52] U.S. Cl. ..... 4/67 R; 4/34; 4/67 A; 4/249

[51] Int. Cl.[2].. E03D 1/34; E03D 5/02; A61B 19/00

[58] Field of Search ..... 4/67 R, 67 A, 57 R, 57 P, 4/1, 34, 37, 249

[56] References Cited

UNITED STATES PATENTS

| | | | |
|---|---|---|---|
| 1,404,308 | 1/1922 | Longshaw | 4/67 R |
| 1,525,475 | 2/1925 | Tutt | 4/67 R |
| 2,962,727 | 12/1960 | Kanter et al. | 4/67 R |
| 3,323,142 | 6/1967 | Schroder | 4/249 |
| 3,896,507 | 7/1975 | Scarritt, Sr. | 4/56 |

*Primary Examiner*—Henry K. Artis
*Attorney, Agent, or Firm*—Malcolm W. Fraser

[57] ABSTRACT

A control for a water closet, enabling the valve actuating float to be adjusted from outside of the tank to enable a relatively small volume of water to be normally introduced to the tank for flushing purposes. By actuation of a simple control, the float may be allowed to rise to a predetermined position at which considerably greater volume of flushing water is made available to handle an increased amount of waste. In this manner, an appreciable economy of water is achieved in a simple and efficient manner. When the control is actuated so that the greater volume of water is made available for flushing, the mechanism is such that after flushing the control automatically resumes its position to admit thereafter the smaller volume of water.

5 Claims, 1 Drawing Figure

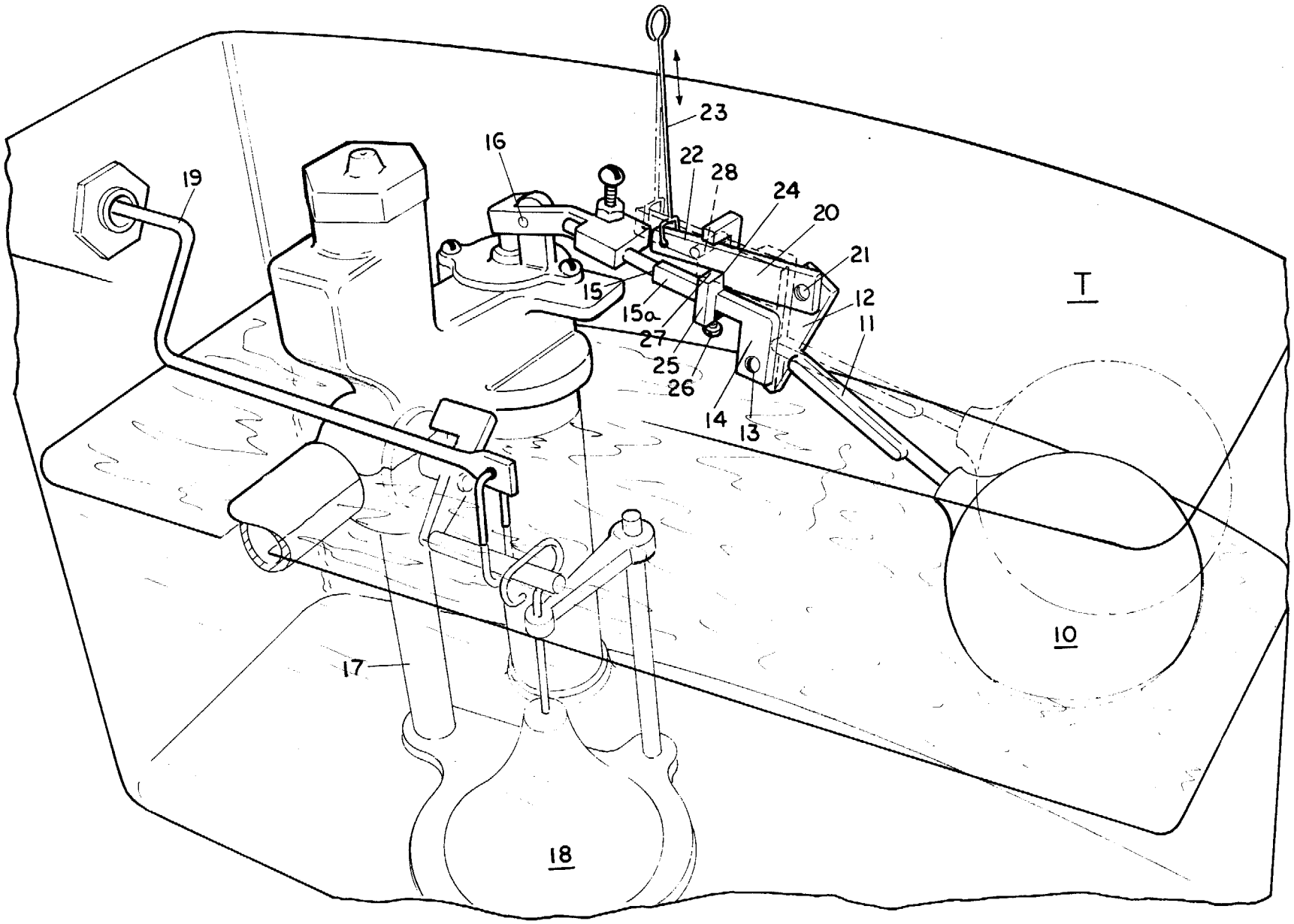
1
10
11
12
13
14
15
15a
16
17
18
19
20
21
22
23
24
25
26
27
28

CONTROL FOR WATER CLOSETS

SUMMARY OF THE INVENTION

According to the invention, the float, which is usually in the form of a cylindrical metal ball and which controls the volume of water admitted to the tank of a water closet, can be adjusted so that a greater or lesser volume of water is admitted to the tank for flushing purposes.

It is understood that when the float ball rises to a certain predetermined position, it effects closure of the water intake valve, and when the float drops to a predetermined position, the water valve is opened to admit water to the tank. In this instance, the control is provided which limits the volume of water admitted to the flushing tank so that an economy of water is effected. This is satisfactory for most flushing purposes. However, in case of greater volume of waste which must be flushed from the water closet, it is merely necessary manually to actuate a wire or arm or other suitable device disposed on the outside of the tank so that the float is permitted to rise to such position as to admit a greater volume of water. An adjustment is possible so as to predetermine the operation of the float so that the volume of water admitted to the tank for flushing purposes can be predetermined.

DESCRIPTION OF THE DRAWING

The FIGURE is a fragmentary top perspective view of the valve mechanism within the tank of a water closet showing the device for adjusting the position of the float in its raised position.

DESCRIPTION OF THE PREFERRED EMBODIMENT

The illustrated embodiment of the invention comprises a water closet tank T, into which water is admitted for flushing purposes, and from which the water is discharged from the bottom of the tank through the usual control valve, as will be hereinafter described. As shown, there is a cylindrical metal float 10 which has an arm 11 fixed to it. On the outer end of the arm is a T-shaped head 12 disposed in an up and down position. Pivoted at 13 to the lower arm of the T-head is a down turned end 14 of a water valve actuating arm 15. The actuating arm 15 is pivoted at 16, and controls the actuation of a water inlet valve (not shown). The water is admitted through a stand pipe 17 extending through the bottom wall of the tank T, and the actuation and structure of such control valves is well known in the trade and further description and illustration thereof is not regarded as necessary.

In the usual manner, water is discharged from the tank through an opening in the bottom wall thereof, and such opening is controlled by a valve 18. Actuation of the valve 18 is effected through link and lever devices 19, which enables the unseating of the valve 18 from the outside of the tank.

In accordance with the invention, the normal position of the float 10 within the tank T can be controlled, and that position is such as to admit a minimum volume of water to the tank for flushing purposes. However, in case greater flushing is required due to additional waste, the position of the float 10 can be raised, thus admitting a greater volume of water. However, so soon as the greater volume of water has been released from the tank, then the control is re-established so that the smaller volume of water is then admitted to the tank.

As shown, there is pivoted to the upper arm of the T-head 12 at 21, one end of an arm 20. The opposite end portion of the arm 20 has a reduced portion, and at the end of this portion is attached an actuating wire 23 which extends to the outside through the top of the tank T. The actuating wire 23 can very properly comprise a rod or other mechanism which is accessible outside the tank for manual operation. The reduced end portion 22 of the arm 20 provides a stop shoulder 24 which can abut against a stop ring 24, and engagement of the shoulder 24 with the ring 25 limits the upward movement of the float 10 so that the water valve is closed at an earlier point of time than would be the case where the float 10 can rise to a greater extent within the tank T. The ring 24, in this instance, has a square hole which rides over the squared portion 15*a* of the arm 15 to enable the ring to be adjusted along the portion 15*a*. When in the desired position, a set screw carried by the ring can be tightened against the arm 15 to secure it in position. It will be seen that the stop ring 25 has an upstanding U-shaped guide portion 27 through which the reduced end portion 22 of the arm 20 can slide. The width of the U-opening in the guide 27 is such as to permit the arm 20 to slide therethrough, and such movement is necessary when it is desired for the float 10 to rise to a greater extent within the tank. However, after the greater volume of water within the tank has been discharged, then the float 10 will swing downwardly so that the shoulder 24 will again be brought into contact with the stop shoulder 24. To limit the movement of the arm 20 in one direction, a stop pin 28 is provided on the reduced portion 22 of the control arm, and this pin abuts against one side of the guide 27 so that the arm 20 can move only so far when the float 10 drops, the movement being such that the shoulder 24 is brought into proper position with respect to the stop ring 25.

From the above description, it will be apparent that, in the normal operation of the device, a relatively small volume of water is used for flushing purposes. However, when a greater volume of water is required, then the wire 23 is pulled to rock the arm 20 so that it can slide through the guide 27 and allow the float ball 10 to rise to a greater extent, thereby to admit a greater volume of water to the tank. When the greater volume of water so introduced to the tank T has been discharged, then the float ball 10 automatically returns to its position at which only minimum volume of water is admitted. In this manner, a considerable volume of water can be saved over a period of time, and this is particularly important in certain communities where the cost of water is substantial.

What I claim is:

1. Control for water closets having a water tank containing a float-actuated valve for predetermining the volume of water admitted to the tank for flushing purposes, said control comprising an operative connection between the float and water valve including a mounting for the float enabling the same to rise selectively to minimum and maximum positions, a device for normally requiring the float to be disposed in such minimum position for admitting the smaller volume of water, a manual actuator for said device to move same to enable movement of the float to such maximum position for admitting the greater volume of water, and means to cause said device to resume float movement to minimum position after said actuator has been operated for flushing purposes.

2. Control as claimed in claim 1, comprising an acticulated operating arm for the float, and a releasable stop device for predetermining the movement of said float.

3. Control as claimed in claim 2, in which said stop device comprises a pivoted stop arm on one part of said operating arm for stop engagement with the other part of said arm, and manual means operable outside of the tank for actuating said stop arm.

4. Control as claimed in claim 1, comprising an operating arm on the float, a T-head on the end of said arm, a water valve-operating arm pivoted to one end of said T-head, a guide device on said water valve arm having an opening, a control arm pivoted to the other end of said T-head and slidable through the opening in said guide device, a stop shoulder on said control arm to engage said guide device thereby to limit the upward movement of said float, and means accessible outside of the tank to rock said control arm to enable it to slide through said opening to enable such movement of the float as to admit a greater volume of water.

5. A control as claimed in claim 4, comprising a stop pin on said control arm to engage the guide device for limiting the sliding movement thereof in one direction.

* * * * *